United States Patent [19]

Morrissette et al.

[11] 4,148,420

[45] Apr. 10, 1979

[54] SELF-SEALING CAPS FOR SQUEEZE-TYPE CONTAINERS

[75] Inventors: Alfred B. Morrissette, Sausalito; Donald W. Nusbaum, Mountain View; Charles B. Briggs, Atherton, all of Calif.

[73] Assignee: Scale Models Unlimited, Menlo Park, Calif.

[21] Appl. No.: 873,484

[22] Filed: Jan. 30, 1978

[51] Int. Cl.[2] ..... B65D 35/52

[52] U.S. Cl. ..... 222/494; 137/846

[58] Field of Search ..... 137/846, 847; 222/490, 222/494

[56] References Cited

U.S. PATENT DOCUMENTS

| | | | |
|---|---|---|---|
| 1,973,459 | 9/1934 | Anderson | 222/490 |
| 2,272,653 | 2/1942 | Andrews | 222/490 |
| 2,611,515 | 9/1952 | Smith | 222/490 X |
| 3,369,666 | 2/1968 | Hultgren et al. | 137/846 X |
| 3,504,699 | 4/1970 | Grisé | 137/846 |

FOREIGN PATENT DOCUMENTS

| | | | |
|---|---|---|---|
| 830772 | 2/1952 | Fed. Rep. of Germany | 222/490 |

*Primary Examiner*—David A. Scherbel
*Attorney, Agent, or Firm*—Lowhurst & Aine

[57] ABSTRACT

A self-sealing cap for squeeze-type containers formed from a moldable material which includes a body portion defining an opening therethrough. One end of the body portion is securable to the squeeze-type container and the other end of the body portion is extended into side walls and end walls which are connected together to form an extension of the opening. The side walls terminate into resilient lip portions which, in turn, terminate into sharp biting edges which are abutting to define a narrow slit. Upon the application of the squeeze pressure to the container, the contents move the lip portions away from one another to form an outlet and upon cessation of squeeze pressure on the container the lip portions return under normal permanent set to close the fit while biting off the contents.

15 Claims, 4 Drawing Figures

SELF-SEALING CAPS FOR SQUEEZE-TYPE CONTAINERS

BACKGROUND OF THE INVENTION

This invention relates to self-closing caps for squeeze-type containers from which the contents is extruded by the application of pressure on the body of the container and in which the lips of the cap close when squeeze pressure is removed from the container.

Heretofore, a number of self-closing caps have been proposed which allow for the extrusion of the content of a deformable container, also referred to as squeeze container, which contains substances such as tooth paste, shaving crean, paints, glue, sauces, food pastes and practically any substance which has a relatively smooth consistency and a viscosity allowing it to be extruded. The term squeeze-type or deformable container includes resilient containers which after being squeezed return to their original shape and deformable containers such as toothpaste tubes which retain their deformed shape.

Generally speaking, deformable containers are used where the substance in the container is to be protected from the exposure to air such as paints, wines etc, or water in case of underwater applications, and resilient containers are used where exposure to air would not be harmful and the substance is to be kept clean and sanitary.

Self-sealing caps for such containers have many advantages in that they require only one hand for dispensing the substance without the necessity of sealing after such dispensing. Such caps also result in a substantial savings in the manufacture of containers and convenience because the normal closure member, such as the threaded cap or stopper and the like, is expensive to manufacture and is easily lost resulting usually in damage to the contents. One particular cogent example is toothpaste or paint which, if left open, will harden because of its exposure to air and therefore become unusable. As far as foods are concerned, contact with air often causes contamination of the food requiring it to be discarded which is most wasteful. In some other instances, lack of closure results in dehydration and the subsequent spoiling of the contents.

There have been many self-closing caps proposed by the prior art but none have shown much commercial success. One major reason for such lack of commercial success may be due to the fact that the prior art self-closing caps did not provide a sufficiently tight seal to prevent air and foreign matter from reaching the substance to be contained. Another major reason for lack of commercial success may be due to the fact that most substances that can be placed into a squeeze-type container are thicker than water and the lips of the prior art self-sealing containers are unable to sever the contents to properly close. Another major reason for the lack of commercial success for the prior art self-closing caps may have been a lack of cleanliness in that much of the substance collected on the outer faces of the lips forming the slit-like opening and became hard and crusty and therefore unsanitary and also interfered with the subsequent extrusion or the proper sealing of the slit-like opening.

SUMMARY OF THE INVENTION

It is an object of the present invention to provide a self-sealing cap which provides a tight seal, even for substances which are commonly defined as thick or having a viscosity which is equal to that or exceeds the viscosity of toothpaste.

It is a further object of the present invention to provide a self-closing cap which does not normally collect extruded substances on the outer faces of the lip and which cleanly bites the contents of the squeeze container upon returning to the sealed or closed position.

It is a further object of the present invention to provide an improved self-sealing cap which is inexpensive, clean, provides a positive seal across the opening, and in the process of closing cleanly cuts off the substance being extruded across the slit-like opening.

In accordance with the self-sealing closure of the present invention, there is provided a body portion having an opening therethrough and being configured on one end for connecting with a deformable container. The other end of said body is extended by a pair of opposite end walls and a pair of opposite side walls which are integrally joined at their edges to defind a chamber which is an extension of the opening in the body through which the contents of the deformable container will be extruded. At least the end portion of the side walls, which define lip portions, are resilient to have a set so that they return to their normal position. The lip portions have rearwardly sloping inner and outer faces which intersect in a sharp lip edge which performs a biting function when the lip portions return to their sealing position.

DETAILED DESCRIPTION OF THE PREFERRED EMBODIMENT

Figure 1:
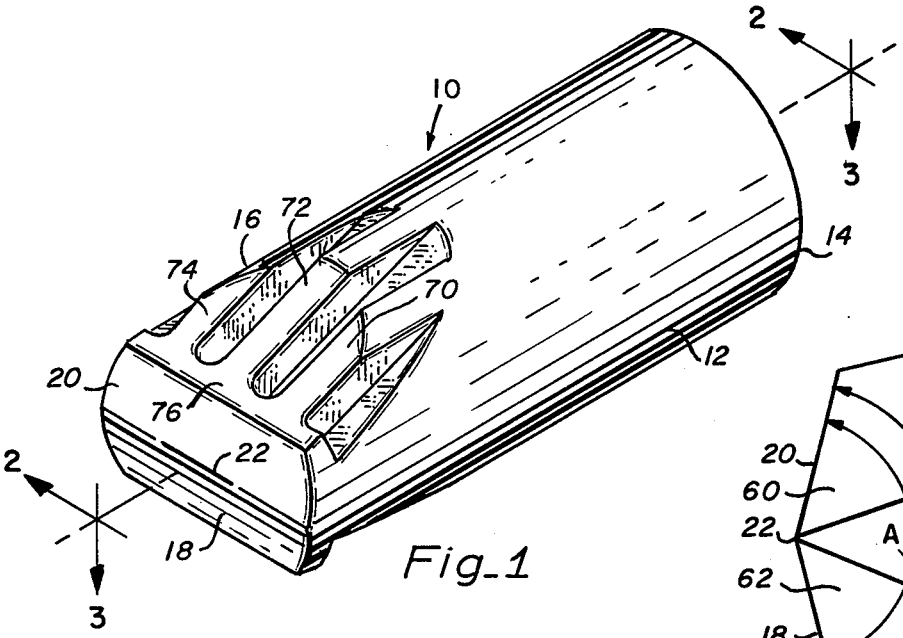
FIG. 1 is a perspective view of the self-sealing cap of the present invention.

Referring now to FIG. 1, there is shown the improved self-sealing cap 10 of the present invention which comprises a body portion 12 having an end portion 14 which is shaped and dimensioned for being secured to a deformable container, and which has another end portion 16, to be described hereinafter, which terminates in a pair of opposed external faces 18 and 20 which define a slit-like opening 22 which is communicated to an interior opening through which the contents of a deformable container may be passed for extrusion.

Figure 2:
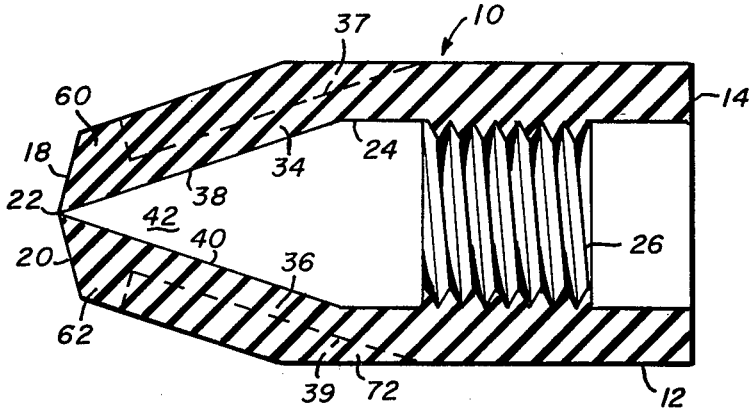
FIG. 2 is a cross-sectional view taken along the horizontal plane of FIG. 1.
Figure 3:
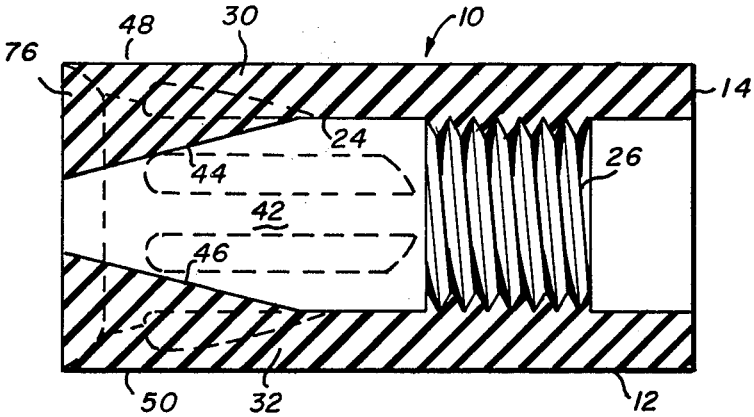
FIG. 3 is a cross-sectional view taken along a vertical plane of FIG. 1.

Referring now more specifically to FIGS. 2 and 3 of the drawing, in which like reference characters designate like parts, there is shown a self-sealing cap 10 having body portion 12. The interior of body portion 12 defines opening 24 which is threaded at 26 near end portion 14 to make it suitable for connection to a container having a male threaded boss, such as a toothpaste tube.

There are also provided a pair of end walls 30 and 32 which are integral with body portion 12, and a pair of side walls 34 and 36 which are likewise integral with body portion 12. The end walls and side walls are also integral with one another and which define a chamber 42 which is an extension of opening 24. Side walls 34 and 36 have internal faces 38 and 40, respectively, which slope rearwardly and outwardly as seen from slot 18 and which define one pair of walls of chamber 42. Side walls 34 and 36 also have rearwardly and outwardly sloping external surfaces 37 and 39, respectively.

End walls 30 and 32 also have outwardly and rearwardly sloping internal faces 44 and 46, respectively, which form the remaining two side walls of chamber 42. The external surface of end walls 30 and 32 may be extensions of body portion 12, as best seen in FIG. 1, which is cylindrical so that the external surface of the end walls is curved.

The end portions of side walls 34 and 36 are referred to as lips or lip portions 60 and 62, respectively, and are constructed from a resilient material. Lip portions 60 and 62 have external faces 18 and 20, respectively, which slope rearwardly and outwardly and interior faces 38 and 40 previously mentioned. The intersections between external face 18 and interior face 38 of lip portion 60 form a sharp lip edge which defines one side of slit-like opening 22, the other side being defined by the sharp lip edge of lip portion 62 formed by the intersection of external face 20 and interior face 40.

Figure 4:
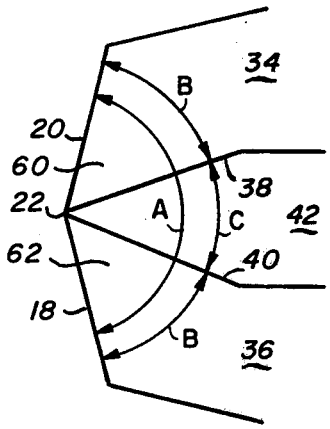
FIG. 4 is a schematic view, similar to the one shown in FIG. 2, useful in explaining some of the geometrical restraints on the cap of the present invention.

Referring now to FIG. 4 of the drawing, there is shown a diagrammatic view of the lip portions 60 and 62 of side walls 34 and 36 showing exterior faces 18 and 20 and interior faces 38 and 40, as well as cavity 42 and opening 20. In accordance with the present invention, the angles subtended by the exterior faces and interior faces are important. If the included angle between the exterior faces is "A" and the included angle between the interior and exterior face of one lip portion is angle "B", and the enclosed angle between the interior face is angle "C", the following considerations form part of the present invention.

In order to obtain a clean biting action without any material collecting on external faces 18 and 20, it has been found necessary to slope these faces rearwardly by an angle of at least about 10°. Accordingly, angle "A" should have a maximum 160° and a suitable minimum has been found to be about 100°. Angle "C" forms the angle between cavity walls 38 and 40 and should be between approximately 40° and 80° so that the substances to be expelled can easily be extruded without undue back pressure being exerted by the walls. As far as angle "B" is concerned, it is likewise of great importance because it determines the biting power the lips can assert. The smaller the angle "B", the less force can be exerted by the lips. It has been found that an angle "B" should be between 20° and 60° to provide acceptable biting power, the larger range of angle being selected for substances of higher viscosity. Since angle "A" is equal to angle "C+2B", there is an important interrelationship so that when angle "A" is at its maximum of 160° and angle "C" is at its minimum of 40°, angle "B" will be at its maximum of 60°.

As best seen in FIG. 1, and in order to enhance the biting and sealing action of lips 60 and 62, there are provided three strengthening or reinforcing longitudinal ribs 70, 71 and 72 on each side wall which extend from body portion 12 to the lip edges. There is further provided a reinforcing cross rib 76 to extend along the entire lip portion edge to assist primarily in the sealing action of the opening. Of course, instead of providing the four reinforcing ribs on each side wall, the side walls may be made sufficiently thick not to require further reinforcing.

There has been described a self-closing cap for a squeeze-type container which may either be of the collapsible or deformable type. The cap may be integrally attached to the container or may be separably connected thereto, such as by a threaded connection. The cap exerts a biting action on the contents by virtue of its sharp lips and is clean of contents by virtue of the rearwardly sloping exterior faces.

What is claimed is:

1. In a squeeze-type container having an openable closure adapted to open for dispensing the contents of the container in response to the application of pressure to the container, the closure comprising:

opposed, resilient, side wall portions terminating on one end into abutting lips;

end wall portions integral with and extending between said side wall portions to opposite ends of said lips said side wall portions and said end wall portions being externally unsupported;

the other end of said side wall portion and said end wall portions being formed and dimensioned for coupling to the container; and said lips having outwardly and rearwardly sloping planar exterior faces and outwardly and rearwardly sloping interior faces, the angle between the center line of the closure and each of said exterior faces is not greater than 80°, the intersection of said exterior and interior faces forming sharp edges which define a normally closed slit-type outlet through which the contents of the container is dispensed.

2. In a container having an openable closure in accordance with claim 1 in which the angle between said interior and exterior faces is between 20° and 60°.

3. In a container having an openable closure in accordance with claim 1 in which the angle between the center line of the closure and each of said exterior faces is not greater than 70°.

4. In a container having an openable closure in accordance with claim 3 in which the angle between the interior and exterior faces is between 30° and 50°.

5. In a container having an openable closure in accordance with claim 1 in which the angle between the center line of the closure and each of said exterior faces is not greater than 60°.

6. In a container having an openable closure in accordance with claim 5 in which the angle between said interior and exterior faces is between 20° and 40°.

7. In a container having an openable closure in accordance with claim 1 in which the angle between the center line of the closure and each of said exterior faces is about 50°.

8. In a container having an openable closure in accordance with claim 7 in which the angle between said interior and exterior faces is about 30°.

9. An integrally molded self-sealing closure cap for a deformable container comprising:

a body portion securable to the container and having an opening therein through which the contents of the container may pass;

a pair of end walls extending from said body portion in substantially parallel relationship on opposite sides of said opening;

a pair of side walls extending from said body portion and secured at their edges to said end walls on opposite sides of said opening, said walls forming a chamber which is an extension of an axial with said opening and being externally unsupported;

said side walls terminating into resilient lip portions which have rearwardly sloping planar internal and external faces, the angle between the center line of the closure and each of said external faces is not greater than 80°, said internal and external faces intersecting one another to form a pair of sharp biting, abutting lip edges which define a very narrow slit extending toward said end walls, said lip edges being free to move from each other to form an output permitting discharge of the container contents upon application of pressure to the container, and being forced to move to oen another to close the outlet and to bite off the container contents at the slit upon termination of the application of pressure to the container as the result of the normal permanent set in said lip portions.

10. A self-sealing closure cap in accordance with claim 9 in which the angle between said rearwardly sloping external faces is between 100° and 160°.

11. A self-sealing closure cap in accordance with claim 9 in which the angle between said internal and external faces of a lip edge is between 20° and 60°.

12. A self-sealing closure cap in accordance with claim 9 in which reinforcing ribs are provided integral with said side walls to increase the biting action of said sharp lip edges upon the termination of pressure to the container.

13. A self-sealing closure cap in accordance with claim 12 in which said ribs extend along the direction of extension of said side walls.

14. A self-sealing closure cap in accordance with claim 12 in which at least one of said ribs extends perpendicularly to the direction of extension of said side walls and has an outer face which forms an extension of said external face.

15. A self-sealing closure cap in accordance with claim 14 in which said remaining ribs extend along the direction of extension of said side walls and terminate into said perpendicularly extending rib.

* * * * *